United States Patent [19]

Drumm

[11] 4,077,081

[45] Mar. 7, 1978

[54] SWEEPER BRUSH SECTION

[76] Inventor: Arthur E. Drumm, Rte. 1, Marysville, Ohio 43040

[21] Appl. No.: 733,899

[22] Filed: Oct. 19, 1976

[51] Int. Cl.[2] ..... A46B 7/10

[52] U.S. Cl. ..... 15/181; 15/198; 15/203

[58] Field of Search ..... 15/181, 183, 198, 200, 15/203, 179

[56] References Cited

U.S. PATENT DOCUMENTS

| | | | |
|---|---|---|---|
| 360,190 | 3/1887 | Williams | 15/181 |
| 2,721,348 | 10/1955 | Blydenburgh | 15/183 |
| 3,274,634 | 9/1966 | Godfrey | 15/198 |
| 3,278,966 | 10/1966 | Godfrey | 15/181 |

*Primary Examiner*—Robert W. Jenkins

*Attorney, Agent, or Firm*—William V. Miller

[57] ABSTRACT

A sweeper brush section comprising a deformed metal channel with a plurality of outwardly-opening cups or sockets at regularly spaced intervals in which are positioned the inner U-shaped ends of tufts or bunches of wire bristles mounted in non-metallic sleeves. These sleeves are pivoted in the respective cups about transverse axis for limited movement to prevent breakage of the bristle wires, especially at the time of the initial impact of the wires with the surface being swept.

2 Claims, 10 Drawing Figures

10
11
2
2
20
14
12
16
22
18
15

3

15
16
22
18
12
3

19
18
17
21
16
15
22
12

SWEEPER BRUSH SECTION

BACKGROUND AND SUMMARY OF THE INVENTION

The present invention relates generally to a brush section formed of a channel body with outwardly extending tufts or bunches of bristles carried thereby. Examples of this general type of brush section are disclosed in my U.S. Pat. Nos. 3,602,936 and 3,855,660.

The present invention provides improvements over the brush sections disclosed in the above patents especially in regard to the manner in which the U-shaped tufts of wire bristles are mounted in the metal channel. This manner of mounting prevents the wire bristles from breaking off just where they extend from the sockets in the metal channel due to the shock of initial impact of the outer ends of the wires with the surface to be swept. It is accomplished mainly by having the U-shaped tufts disposed at their inner ends in non-metallic sleeves, which are, in turn, mounted for limited pivotal movement in the respective sockets about transverse axis. The method by which this assembly is made is very simple.

BRIEF DESCRIPTION OF THE DRAWINGS

The best mode contemplated in carrying out this invention is illustrated in the accompanying drawings in which.

DETAILED DESCRIPTION OF THE INVENTION

Figure 1:
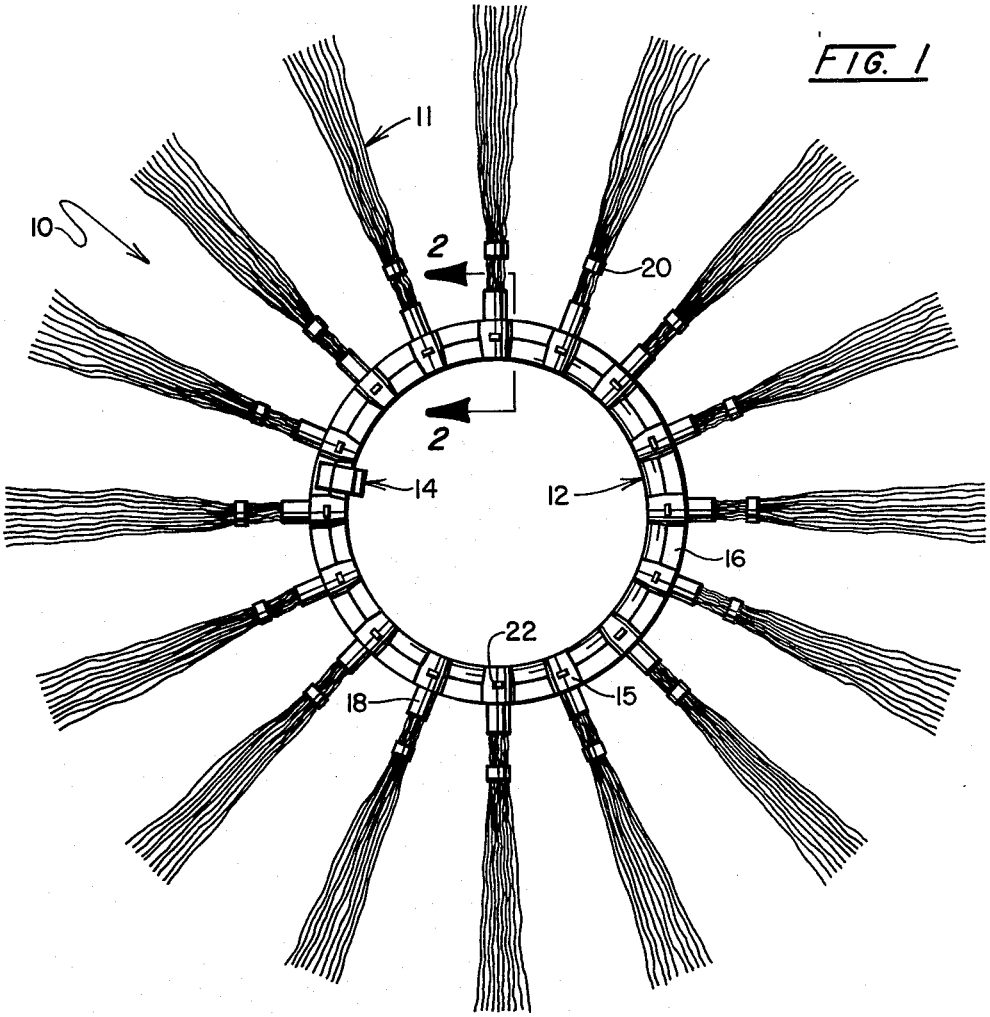
FIG. 1 is a side elevational view of a brush section embodying the present invention.
Figure 2:
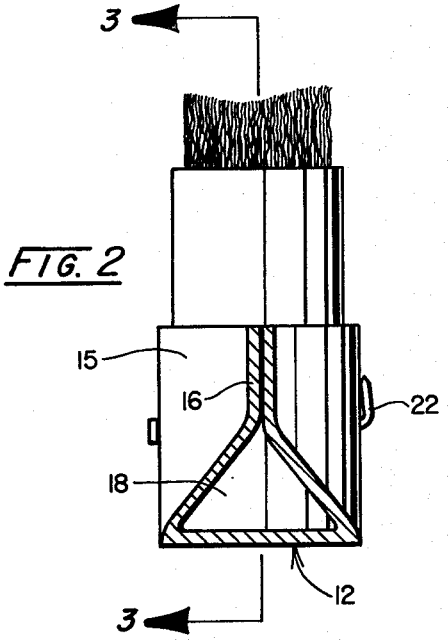
FIG. 2 is a transverse sectional view taken along line 2—2 of FIG. 1.
Figure 3:
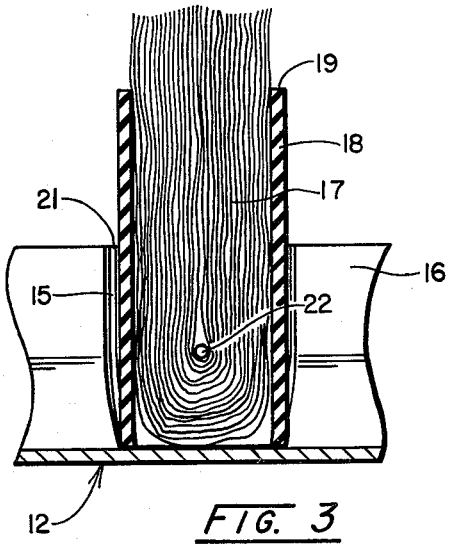
FIG. 3 is a sectional view taken along line 3—3 of FIG. 2.

One form of the present invention is shown in FIGS. 1 to 4 embodied in a brush section of the general type disclosed in my U.S. Pat. No. 3,602,936. The brush section is indicated generally by the numeral 10 and includes the radially extending bristles 11 attached at their inner ends to a metal ring 12 which is split where a connecting and driving member 14 is provided.

The ring 12 is preferably of metal, being formed from a channel of U-shaped cross-section, opening outwardly and deformed to provide the outwardly-opening cups or sockets 15 at regular angularly spaced intervals. An important feature of this invention is that the outwardly-opening sockets are formed integrally in the metallic channel by a suitable die-pressing or other channel-crimping operation. It will be noted that the sockets 15 open outwardly, but in between these sockets, the opposed walls of the channel are pinched tightly together substantially into contact with each other as indicated at 16.

In each of these sockets 15, is mounted a tuft of wire, which as shown, has a double U-shaped inner end 17. Tightly surrounding the inner end of each tuft, is a tubular protective member 18 which is open at both its inner and outer ends and is slipped over the tuft of wire before it is mounted on the ring. This tubular member is preferably of a short length of rubber or plastic hose and is of such length that it extends into the socket beyond the bend or loop in the outermost wires (FIG. 3) and outwardly to a point 19 substantially radially outwardly of the metal ring or outer extremity of the socket 15. This is important to prevent breaking of the wires 11 by contacting with the outer edges of the sockets at the time of starting the sweeping or due to later "whip action" of the wire tufts.

In addition to the tubular member 18, each wire tuft is provided with a similar non-metallic ring 20 at a point spaced radially outwardly of the point 19 so as to hold the inner portions of the wires of each tuft together.

Figure 4:
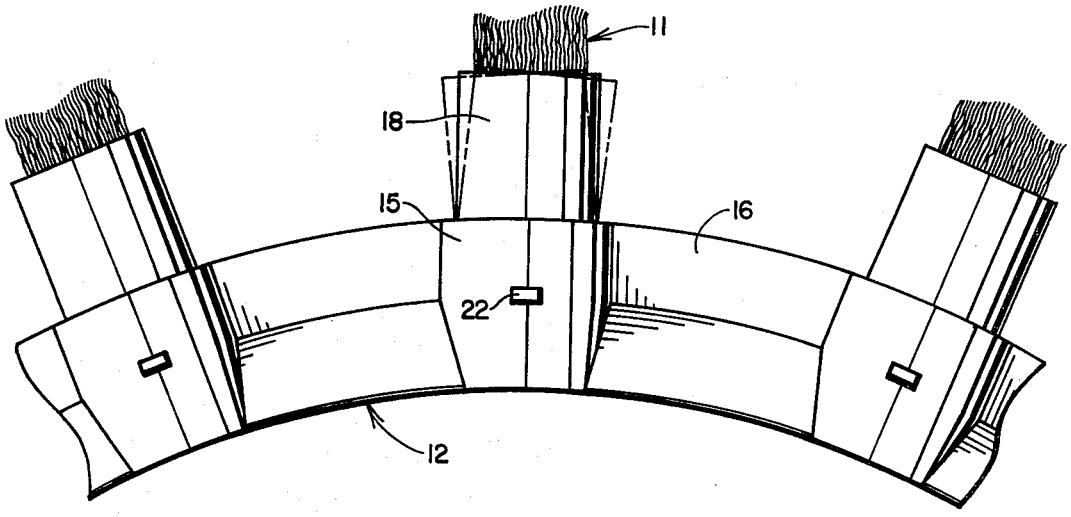
FIG. 4 is an enlarged elevational view of a part of the ring brush section of FIG. 1.

It will be noted that the sockets 15 are tapered or flared to provide outer ends which are slightly greater in diameter than the external diameter of the sleeve member 18 so that an annular space 21 is provided between each sleeve and the socket wall, this space gradually decreasing inwardly. The sockets 15 at their inner ends will be slightly less in diameter than each sleeve 18 which will be forced thereinto until they bottom in its socket. To hold the sleeve member 18 and its enclosed wire tuft, within the socket, a pin 22 is passed transversely through the socket wall, the sleeve member, and the wire tuft, passing within the U-bend thereof. This, as indicated in FIG. 4 by broken lines, will allow for limited pivotal movement of the sleeve longitudinally or in the plane of the ring at the initial contact of the brush tuft with the surface to be swept or to take care of any whip action. Thus, breaking of the wires of the tuft will be prevented by this arrangement along with the provision of the sleeve member 18.

The pins 22 may be in the form of any of various types of suitable fastening members, such as cotter-pins, nails, bolts, etc., or fasteners of the type forced by a ram-gun through the opposed walls of the metallic channel.

Figure 5:
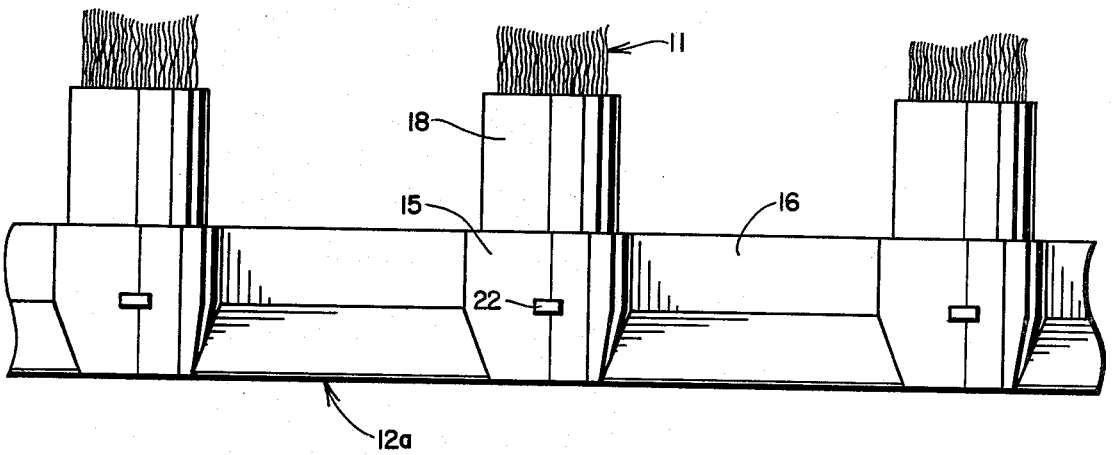
FIG. 5 is a similar view of a part of a straight brush section.

The structure just described has the metal channel bent into ring form. However, instead of being formed as a ring section 12, the invention may be embodied in a straight section **12*a*, as indicated in FIG. 5. It will have the some sockets 15 formed at longitudinally spaced intervals to receive the tubular members 18** as before.

Figure 6:
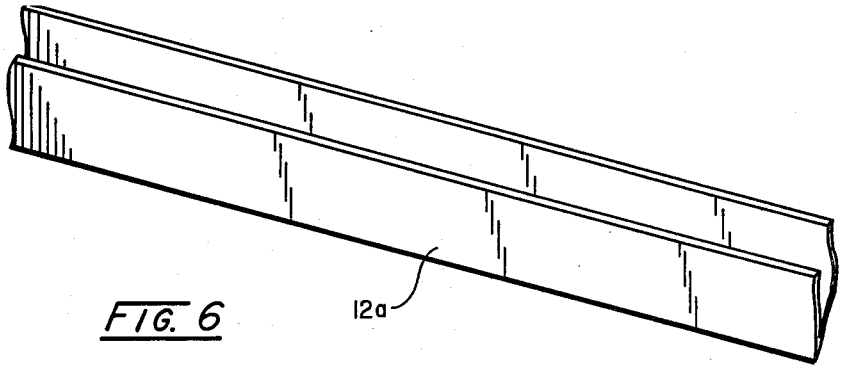
FIG. 6 is a perspective view showing a metal channel used in forming the brush section.
Figure 7:
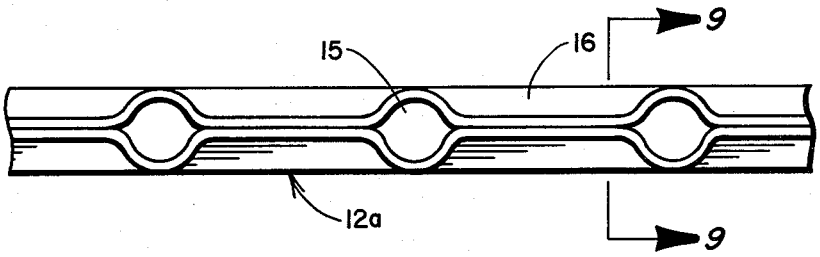
FIG. 7 is a plan view showing the metal channel deformed to provide sockets which receive the tuft-carrying sleeves.
Figure 8:
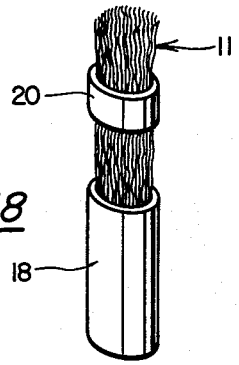
FIG. 8 is a perspective view of one of the sleeve-carried wire tufts.
Figure 9:
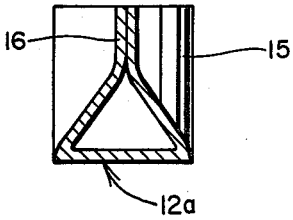
FIG. 9 is a transverse section taken along line 9—9 of FIG. 7.
Figure 10:
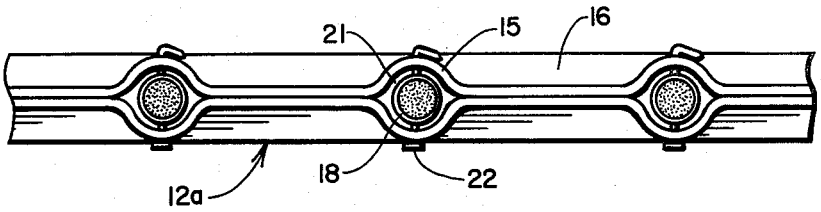
FIG. 10 is a view like FIG. 7 but showing the tufts in place.

As indicated, the brush section of this invention can be formed by a simple, inexpensive, high-production method. As shown in FIG. 6, it starts with an ordinary channel **12*a* of deformable metal. The wire tufts are enclosed in the sleeves 18 ready to be mounted in the sockets, one being shown in FIG. 8. The tapered sockets 15 are formed in the metal channel by suitably deforming it, before insertion of the members 28, into the condition shown in FIG. 7, and in FIG. 9 which shows a section of substantially Y-form. The sockets will be integrally formed in the metallic channel. The sleeve-carried tufts may then be inserted in the sockets 15 and then the fasteners 22** may be inserted.

It will be apparent that this invention provides a simple brush section in which the tufts of wire bristles are mounted in the channel body in a very simple, inexpensive manner, for limited swinging movement longitudinally of the channel so that the wires are protected from being broken by sudden shocks, in either direction, during the sweeping operation. In making the brush section, it is not necessary to use separate socket members mounted on metal bands, separate spacer members in the channel, a retaining wire member extending through the channel, or the innumerable other complicated parts used in the prior art, which resulted in complicated and costly assembly methods.

Having thus described the invention, what is claimed is:

1. A brush section comprising a channel body having spaced outwardly-opening bristle-receiving sockets, tufts of bristles disposed in said sockets, means for securing the tufts in said sockets, said means comprising sleeve members enclosing the inner ends of said tufts but extending outwardly from said sockets, said sockets being slightly larger than the sleeve members in the direction of extent of the body, and fasteners extending transversely through said sockets and sleeves to permit limited pivotal movement of said sleeves longitudinally of the body, said tufts of the bristles being doubled into U-form with the U-form ends enclosed within said sleeve members, said fasteners also passing through amd within the U-form ends of the tufts, said channel body being of metal deformed to provide outwardly opening tubular sockets, said sleeve members being non-metalic tubular members, the fasteners passing through said members at points spaced outwardly from the inner extremities thereof, said tubular sockets tapering and being of greater diameter of their outer ends than the outer diameter of the sleeve members, but of lesser diameter at their inner ends than the diameter of the inner extremity of said sleeve members.

2. A brush section, according to claim 1, in which the metal channel is crimped to provide sections between the sockets which are pinched substantially together.

* * * * *